United States Patent [19]

Sargent

[11] 4,416,132

[45] Nov. 22, 1983

[54] METAL FORMING LUBRICANT AND METHOD OF USE THEREOF

[75] Inventor: Donald J. Sargent, West Lafayette, Ind.

[73] Assignee: E/M Lubricants, Inc., West Lafayette, Ind.

[21] Appl. No.: 479,017

[22] Filed: Mar. 25, 1983

Related U.S. Application Data

[62] Division of Ser. No. 276,937, Jun. 24, 1981.

[51] Int. Cl.[3] ..... B21B 45/02

[52] U.S. Cl. ..... 72/41; 72/42; 72/46; 252/18; 252/49.5

[58] Field of Search ..... 252/18, 49.5; 413/1; 72/41, 42, 46

[56] References Cited

U.S. PATENT DOCUMENTS

| | | | |
|---|---|---|---|
| 1,948,194 | 2/1934 | Williams | 252/49.5 |
| 2,686,488 | 8/1954 | Montgomery | 72/46 |
| 3,629,112 | 12/1971 | Gower et al. | 252/49.5 |
| 3,843,529 | 10/1974 | Bertrand | 252/49.5 |
| 3,873,458 | 3/1975 | Parkinson | 252/49.5 |
| 4,292,095 | 9/1981 | Schlinsog | 72/46 |
| 4,303,537 | 12/1981 | Laepple et al. | 72/42 |

*Primary Examiner*—Francis S. Husar
*Assistant Examiner*—David B. Jones
*Attorney, Agent, or Firm*—Kirkland & Ellis

[57] ABSTRACT

The present invention relates to a lubricant for use in the drawing and ironing of black plate steel during the manufacture of enclosed containers such as cans. The lubricant comprises an aqueous solution of an active component, such as a major portion of molybdenum disulfide, together with minor amounts of waxes and other materials. In performing the method of the present invention, a lubricant system is employed. The lubricant system comprises a dual lubricant coating. The first, or outside, coating is applied to that portion of the black plate steel which ultimately becomes the outside surface of the can body. The outside coating is applied, such as by spraying or gravure or offset printing, at a rate of about 25 to about 200 milligrams per square foot of steel surface. This coating is dried, as through the use of a heat source, such as infrared heat or hot air. A second, or inside, coating is applied to that portion of the black plate steel which ultimately becomes the inside surface of the can body. The inside coating may also be applied to the surface of the black plate steel in a manner similar to that used for the application of the outside coating. After the can body is produced, the outside and inside lubricants must be totally removed. Such removal may be achieved by washing the can bodies in an alkaline solution (pH about 7.5 to 11.5) having a temperature of about 140° to about 160° F.

10 Claims, No Drawings

METAL FORMING LUBRICANT AND METHOD OF USE THEREOF

This is a division, of application Ser. No. 276,937, filed June 24, 1981.

BACKGROUND OF THE INVENTION

1. Field of the Invention

The present invention relates to a lubricant for metal forming and the method of use of the lubricant. In particular, the lubricant is especially useful in the manufacture of cans from black plate or tin-free steel.

2. Description of the Prior Art

Until fairly recently, it was usual practice in the can-making industry to make cans out of tin-plated sheet steel. By this process, the tin-plated sheet steel was rolled in cylindrical form, welded or soldered and enclosed by the placement of end plates (i.e., a top and a bottom) to form the complete can. Cans manufactured in this manner are generally referred to in the can-making industry as "three-piece cans" (the three pieces being the cylindrical body, the bottom and the top).

In order to improve upon the previous three-piece tin-plated sheet steel cans, the can-making industry has commenced manufacturing cans from aluminum. Aluminum cans may also be made in the three-piece fashion. More recently, however, the can-making industry developed technology which enabled the can body to be drawn and ironed in a manner which resulted in one end, i.e., the bottom, being an integral part of the can body. The use of this technology requires that a second piece, namely a top, be attached to the cylindrically formed, enclosed-bottom body in order to create the finished can product. Such cans are generally referred to in the can-making industry as "two-piece, drawn and ironed cans".

The two-piece, drawn and ironed cans may be made from materials such as tin-plated steel or aluminum. In the situation in which the can is made of aluminum, the metallurgical properties of aluminum are such that it can be drawn and ironed with a minimum of supplemental lubrication. In the case of two-piece, drawn and ironed cans made from tin-plated steel, one skilled in the art will recognize that the tin acts as a protective barrier for beverage, foodstuff or other material to be packaged in the container and also acts as a lubricant to facilitate the drawing and ironing of the can.

While the foregoing methods of manufacturing produce cans which are of a high quality, it has been determined that the cost of producing such cans may be decreased substantially if the cans are manufactured from steel which is free of tin. Such steel is referred to interchangeably by those in the industry as "black plate", or "tin free" steel (for the purpose of the instant invention, the former designation will be used, it being understood that "black plate" steel and "tin plate" steel are synonymous). However, the metallurgical properties of black plate steel are such that it is not possible to simply draw and iron a can body (i.e., the cylindrical body witn an enclosed end) as has been the case with either aluminum or tin-plated steel. Indeed, the use of black plate steel in the metal forming operations required to produce a can are such that a lubricant coating must be applied to the black plate steel prior to the forming operation. In addition, because the lubricant is only needed during the drawing and ironing operations, the lubricant must be capable of being easily removed from the can prior to subsequent treatment and filling.

BRIEF DESCRIPTION OF THE INVENTION

The present invention relates to a lubricant for use in the drawing and ironing of black plate steel during the can manufacture of enclosed containers such as cans. In particular, the lubricant is applied to that portion of the black plate steel which ultimately becomes the outside surface of the can body. The lubricant comprises an aqueous solution of an active component, such as a major portion of molybdenum disulfide, together with minor amounts of waxes and other materials.

In performing the method of the present invention, a lubricant system is employed. The lubricant system comprises a dual lubricant coating. The first, or outside, coating is applied to that portion of the black plate steel which ultimately becomes the outside surface of the can body. The outside coating is applied, such as by spraying or gravure or offset printing, at a rate of about 25 to about 200 milligrams per square foot of steel surface. This coating is dried, as through the use of a heat source, such as infrared heat or hot air.

A second, or inside, coating is applied to that portion of the black plate steel which ultimately becomes the inside surface of the can body. The inside coating acts as stripping lubricant to permit ready removal of the formed article from the punch tooling piece. The inside coating may also be applied to the surface of the black plate steel in a manner similar to that used for the application of the outside coating. However, the amount of the inside coating applied to that surface is less critical. In addition, although it is desirable to completely dry the inside coating prior to the ironing step, that is not necessary.

After the can body is produced, the outside and inside lubricants must be totally removed. Such removal may be achieved by washing the can bodies in an alkaline solution (pH about 7.5 to 11.5) having a temperature of about 140° to about 160° F.

Thus, it is a principal object of the present invention to provide a lubricant for application to the surface of black plate steel which ultimately becomes the exterior of a can.

It is also a principal object of the present invention to provide a method for using the lubricant of the present invention in the manufacture of cans from black plate steel.

It is yet another object of the present invention to provide a dual lubricant system; the first or outside, lubricant applied to the surface of the black plate steel which ultimately becomes the exterior of the can and the second, or inside, lubricant applied to the surface of the black plate steel which ultimately becomes the interior of the can.

Yet another object of the present invention is to provide a lubricant and dual lubricant system for the use in the manufacture of black plate steel cans which lubricant system may be easily removed from the can body through washing.

These and other objects, advantages, and features of the present invention shall fully appear in the description of the preferred embodiment which hereinafter follows.

DETAILED DESCRIPTIONS OF THE PREFERRED EMBODIMENT

As is well recognized in the art of can manufacturing, the operation of making a two-piece, drawn and ironed can comprises a number of discrete steps, the first of which being the cutting of a blank out of sheet steel. The blank is positioned in a drawing apparatus where it is drawn into a cup. The drawn cup is then subjected to an ironing step which stretches, or elongates, the cup to the full length of the can to be produced. The ironed can is then trimmed and a neck is formed on the upper, or open, end of the can. The necked can is flanged for receipt of the top enclosure.

When using black plate steel to manufacture a two-piece can, it is necessary to coat the surfaces of the steel prior to the drawing and ironing steps. For convenience, the coating may be applied to the steel prior to formation of the blank. In the present invention, a first coating, adapted for use on that portion of the black plate steel which ultimately becomes the outside of the can body, is provided. This coating comprises a lubricant material which facilitates the drawing and ironing of the steel.

It has been determined that the first coating lubricant material may advantageously comprise a major amount of a compound comprised of Group VIa and Group VIb elements of the Periodic Table together with minor amounts of unsaturated fatty acids, amines and synthetic wax emulsions, among other materials. For the purposes of the present invention, the first coating lubricant formulation may be that as found in either Table I or Table II hereof.

TABLE I

| Component | First Coating % Range (by weight) |
|---|---|
| Terpene Phenolic Resin | 2.5–3.75 |
| Esterified Styrene Maleic Anhydride | 0.3–2.5 |
| Synthetic Polymethylene Wax | 2.5–3.75 |
| Unsaturated fatty acid | .3–2.0 |
| Amines | .3–2.0 |
| Potassium Hydroxide | .05–0.5 |
| Group VIa/Group VIb compound | 24.0–32.0 |
| Synthetic Wax Emulsion | 8.5–11.5 |
| Surfactant | .003–.025 |
| Silicone Antifoam | 0–0.02 |
| Distilled Water | — |

TABLE II

| Component | First Coating % Range (by weight) |
|---|---|
| Emulsifiable Microcrystalline Wax | 2.0–10.0 |
| Refined Microcrystalline Wax | 3.5–11.75 |
| Unsaturated Fatty Acid | .2–1.0 |
| Nonylphenoxypolyethoxy Ethanol | .75–3.5 |
| Amines | .4–1.75 |
| Group VIa/Group VIb compound | 24.0–32.0 |
| Synthetic Wax Emulsion | 8.5–11.5 |
| Surfactant | 0–.025 |
| Silicone Antifoam | 0–0.02 |
| Distilled Water | — |

With reference to the foregoing Table I, it is noted that distilled water is present in an amount sufficient to provide a 100% by weight composition to the formulation. With respect to the active ingredients of the first coating lubricant formulation found in Table I, it has been discovered that the Group VIa/Group VIb compound referred to herein may advantageously be chosen from the group comprising molybdenum disulfide, molybdenum diselenide, tungsten disulfide and tungsten diselenide.

In addition, the following components of the first coating described in Table I may have the characteristics noted in Table III:

TABLE III

| Component | Characteristics | |
|---|---|---|
| Terpene phenolic resin | Specific gravity: | 1.07 to 1.11 |
| | Softening point: | 338 to 356° F. |
| | Acid Number: | 54 to 62 |
| | Color (Gardner): | 12 |
| Esterified Styrene Maleic Anhydride | Mol. Wt.: | 1800 to 2200 |
| | Acid Number: | 220 ± 15 |
| | Melting Point: | 275 to 302° F. |
| Synthetic Polymethylene Wax | Melting Point: | 220 to 230° F. |
| | Acid Number: | Nil |
| | Saponification Number: | Nil |
| | Penetration: | 1 to 5 |

The unsaturated fatty acid of Table I may be a combination of oleic acid (48 to 49.5% by weight), linoleic acid (48 to 49.5% by weight) and rosin acids (1 to 4% by weight). Finally, the amines of Table I may be a combination of diethylaminoethanol and 1-oxa-4 azacyclohexane.

With respect to the synthetic wax emulsion component of the formulation of Table I, it has been discovered that this component may comprise vegetable oil, such as rapeseed or soybean oil, of 5 to 15% by weight, paraffin wax (melting point 125° to 150° F.) of 1 to 10% by weight, an emulsifier, such as sorbitan or mono-oleate, of 2 to 5% by weight and the remainder as water. The synthetic wax emulsion component usable in the first coating of Table I also may be such commercial products as Lube 692 sold by Brulin & Company, Inc., Indianapolis, Ind. or Wax Draw 700 sold by S. C. Johnson & Co. The surfactant may be a polyethylene glycol ether of linear alcohols, such as Tergitol 15-5-7 sold by Union Carbide; the silicone antifoam may be a dimethyl siloxane fluid such as DC 200 sold by Dow Corning.

As one skilled in the art will appreciate, the surfactant and silicone antifoam agents are useful in dispersing the solids in the lubricant and providing anti-foaming properties to the first coating lubricant formulation. In this regard, certain applications of the Table I formulation are of such a nature as to not require the use of the antifoam component and, accordingly, in such applications that component may be deleted from the formulation without adversely affecting the performance of the first coating lubricant.

With respect to Table II, it is also noted that distilled water is present in an amount sufficient to provide a 100% by weight composition to the first coating lubricant formulation. With respect to the active ingredients of the first coating lubricant formulation found in Table II, the Group VIa/Group VIb compound, described above, is also present.

In addition, the following components of the first coating described in Table II may have the characteristics noted in Table IV:

TABLE IV

| Component | Characteristics | |
|---|---|---|
| Emulsifiable Microcrystalline Wax | Melting Point: | 200 to 215° F. |
| | Acid Number: | 43 to 50 |
| | Saponification Number: | 70 to 85 |
| | Needle Penetration (ASTM D1321) | 20 to 40 |

TABLE IV-continued

| Component | Characteristics | |
|---|---|---|
| | Color (ASTM D1500) | .5 to 1.0 |
| Refined Microcrystalline Wax | Melting Point: | 182 to 187° F. |
| | Saponification Number: | Nil |
| | Needle Penetration (ASTM D1321) | 13 to 18 |
| | Color (ASTM D1500) | 1.0 to 2.5 |

The unsaturated fatty acid, amines, synthetic wax emulsion, surfactant and silicone antifoam of the Table II formulation may be the same as those previously described in respect of the Table I formulation. Likewise, the silicone antifoam and the surfactant may, or may not, be present as previously noted depending upon the application of this first coating lubricant formulation.

In the method of the present invention, a dual lubricant system is provided. The first, or outside, lubricant is the same as previously described. The second, or inside, lubricant is adapted for application to the surface of the black plate steel which ultimately becomes the inside of the can body.

Through experimentation, it has been determined that the second coating lubricant of the lubricant system of the present invention may have the formulation as disclosed in Table V hereof.

TABLE V

| Component | Second Coating % Range (by weight) |
|---|---|
| Synthetic Wax Emulsion | 5.0–20.0 |
| Distilled Water | — |

As will be noted from Table V, the major active ingredient of the second coating lubricant is a synthetic wax emulsion. Distilled water is present in an amount sufficient to provide a 100% by weight composition.

In using the lubricant system of the present invention in the drawing and ironing of black plate steel for can manufacturing, it is necessary to apply the first coating to that portion of the steel sheet which ultimately becomes the outside of the can body. The first coating is applied, as by spraying or gravure or offset printing, at a rate of from about 25 to about 200 milligrams per square foot of steel surface. Although the first coating may be "air cured", in order to speed up the process of curing it is desirable to subject the applied first coating lubricant to heat, as by infrared heating or hot air heating to speed the curing process. In any event, it is necessary to ensure that prior to the drawing operation the first coating lubricant has been completely dried.

The second coating lubricant, as exemplified by the formulation found in Table V, must be placed on that surface of the black plate steel which ultimately becomes the inside of the can body. The second coating lubricant may be applied in a manner similar to that used for the application of the first coating lubricant, or by any other method which ensures that the respective surface of the steel is completely coated with the second coating lubricant. The amount of the second coating lubricant applied to that surface is less critical than the amount of the first coating lubricant to be applied to the opposite surface. Accordingly, the second coating lubricant may be poured on the respective surface. In addition, it is not critical that the second coating lubricant be completely dry prior to the ironing process, although such is desirable.

Once the can body is produced, it is necessary to remove both the first and second coating lubricants from the can body. The lubricants disclosed in Tables I through III herein are soluble in alkaline solutions. Accordingly, removal of these coatings can be achieved by merely washing the can bodies in alkaline solutions, with the initial washing preferably done in an alkaline solution which has a temperature in the range of from about 140° to about 160° F. Washing of can bodies, whether aluminum, tin-plate or black plate steel, is a recognized step in can manufacturing operations.

It should be apparent from the foregoing that various modifications, alterations and changes may be made to the embodiment as described herein without departing from the spirit and scope of the present invention as defined in the appended claims. In particular, while the invention has been described with reference to the use of the lubricant system in the drawing and ironing of cans, such system is also applicable to other metal forming operations, such as draw-redraw and cold and warm forming. All of these uses are contemplated in the present invention.

I claim:

1. A composition for use as a lubricant in metal forming operations using black plate steel comprising:

2.5 to 3.75 percent terpene phenolic resin, 0.3 to 2.5 percent esterified styrene maleic anhydride, 2.5 to 3.75 percent synthetic polymethylene wax, 0.3 to 2.0 unsaturated fatty acid, 0.3 to 2.0 percent amines, 0.05 to 0.5 percent potassium hydroxide, 24.0 to 32.0 percent of a compound comprising an anion selected from Group VIb of the Periodic Table and a cation selected from Group VIa of the Periodic Table, 8.5 to 11.5 percent synthetic wax emulsion and the remainder distilled water.

2. The composition of claim 1, wherein the said Group VIA/Group VIb compound is selected from the group comprising molybdenum disulfide, molybdenum diselenide, tungsten disulfide and tungsten diselenide.

3. The composition of claim 1 further including 0 to 0.25 percent surfactant.

4. The composition of claim 1 further including 0 to 0.02 percent silicone antifoam.

5. The composition of claim 3 further including 0 to 0.025 percent surfactant and 0 to 0.02 percent silicone antifoam.

6. In a method of forming two piece cans from black plate steel in which a blank is produced from the black plate steel and the blank is subjected to drawing and ironing operations to produce an elongated can body, the improvement comprising the additional steps of:

a. prior to the drawing operation, coating the portion of the black plate steel which ultimately becomes the exterior of the can body with a first coating lubricant, said first coating lubricant comprising 2.5 to 3.75 percent terpene phenolic resin, 0.3 to 2.5 percent esterified styrene maleic anhydride, 2.5 to 3.75 percent synthetic polymethylene wax, 0.3 to 2.0 percent unsaturated fatty acid, 0.3 to 2.0 percent amines, 0.05 to 0.5 percent potassium hydroxide, 24.0 to 32.0 percent of a compound comprising an anion selected from Group VIb of the Periodic Table and a cation selected from Group VIa of the Periodic Table, 8.5 to 11.5 percent synthetic wax emulsion and the remainder distilled water;

b. drying the first coating lubricant;

c. coating the portion of the black plate steel which ultimately becomes the interior of the can body with a second coating lubricant, said second coating comprising 5.0 to 20.0 percent synthetic wax emulsion and the remainder distilled water; and d. after the ironing operation, removing said first and second coating lubricants by washing the elongated, enclosed can body in a slightly alkaline solution.

7. In a method of forming two piece cans from black plate steel in which a blank is produced from the black plate steel and the blank is subjected to drawing and ironing operations to produce an elongated can body, the improvement comprising the additional steps of:

a. prior to the drawing operation, coating the portion of the black plate steel which ultimately becomes the exterior of the can body with a first coating lubricant, said first coating lubricant comprising 2.5 to 3.75 percent terpene phenolic resin, 0.3 to 2.5 percent esterified styrene maleic anhydride, 2.5 to 3.75 percent synthetic polymethylene wax, 0.3 to 2.0 percent unsaturated fatty acid, 0.3 to 2.0 percent amines, 0.05 to 0.5 percent potassium hydroxide, 24.0 to 32.0 percent of a compound comprising an anion selected from Group VIb of the Periodic Table and a cation selected from Group VIa of the Period Table, 8.5 to 11.5 percent synthetic wax emulsion and the remainder distilled water, b. coating the portion of the black plate steel which ultimately becomes the interior of the can body with a second coating lubricant, said second coating lubricant comprising 5.0 to 20.0 percent synthetic wax emulsion and the remainder distilled water;

c. drying the first and second coating lubricants; and d. after the ironing operation, removing the first and second coating lubricants by washing the elongated, enclosed can body in a slightly alkaline solution.

8. The method of claims 6 or 7 wherein the said Group VIa/VIb compound is selected from the group comprising molybdenum disulfide, molybdenum diselenide, tungsten disulfide and tungsten diselenide.

9. The method of claim 8 wherein the said first coating lubricant further includes 0 to 0.25 percent surfactant and 0 to 0.02 percent silicone antifoam.

10. The method of claims 6 or 7 where said first coating lubricant further includes 0 to 0.25 percent surfactant and 0 to 0.02 percent silicone antifoam.

* * * * *

UNITED STATES PATENT AND TRADEMARK OFFICE

CERTIFICATE OF CORRECTION

PATENT NO. : 4,416,132

DATED : November 22, 1983

INVENTOR(S) : Donald J. Sargent

It is certified that error appears in the above-identified patent and that said Letters Patent are hereby corrected as shown below:

Col. 6, line 41, Claim 3 "0 to 0.25 percent" should be --0 to 0.025 percent--.

Col. 8, line 19, Claim 9 "0 to 0.25 percent" should be --0 to 0.025 percent--.

Col. 8, line 22, Claim 10 "0 to 0.25 percent" should be --0 to 0.025 percent--.

Signed and Sealed this

*Twenty-third* Day of *April 1985*

[SEAL]

*Attest:*

DONALD J. QUIGG

*Attesting Officer* *Acting Commissioner of Patents and Trademarks*